US006994773B2

(12) United States Patent
Beisswanger et al.

(10) Patent No.: US 6,994,773 B2
(45) Date of Patent: Feb. 7, 2006

(54) METHOD AND APPARATUS FOR THE TRANSFERRING OF A FLEXIBLE MATERIAL WEB

(75) Inventors: Rudolf Beisswanger, Steinheim (DE); Wolfgang Drefs, Hüttlingen (DE); Allan Broom, Coqultlam (CA); Sylvain Demers, St. Louis de France (CA)

(73) Assignee: Voith Paper Patent GmbH, Heidenheim (DE)

( * ) Notice: Subject to any disclaimer, the term of this patent is extended or adjusted under 35 U.S.C. 154(b) by 203 days.

(21) Appl. No.: 09/902,339

(22) Filed: Jul. 10, 2001

(65) Prior Publication Data

US 2002/0053414 A1 May 9, 2002

(30) Foreign Application Priority Data

Jul. 10, 2000 (DE) ..... 100 33 456

(51) Int. Cl.
*D21F 1/36* (2006.01)
*D21F 7/00* (2006.01)
*B65H 35/02* (2006.01)

(52) U.S. Cl. ..... 162/286; 162/193; 162/194; 162/195; 226/91; 83/23; 83/56

(58) Field of Classification Search ..... 162/120, 162/193–195, 199, 255, 283, 286, 260, 270; 226/91, 92; 83/23–28, 39, 53, 56, 78; 242/525, 242/526

See application file for complete search history.

(56) References Cited

U.S. PATENT DOCUMENTS 3,355,349 A * 11/1967 Devlin ..... 162/286
4,923,567 A * 5/1990 Liedes et al. ..... 162/193
4,997,524 A * 3/1991 Nieminen et al. ..... 162/193

FOREIGN PATENT DOCUMENTS

DE 200 11 943 U1 11/2000
EP 1179632 7/2001
WO WO 98/33974 8/1998

* cited by examiner

*Primary Examiner*—Eric Hug
(74) *Attorney, Agent, or Firm*—Taylor & Aust, P.C.

(57) ABSTRACT

An apparatus is available for transferring a flexible material web from an upstream section to at least one downstream section of a machine having a web running direction. The machine is configured for at least one of manufacturing and treating the material web. The apparatus includes two separation elements configured for splitting and thereby separating the material web into an edge strip, an adjoining transfer strip and a remaining web adjoining the transfer strip, the edge strip extending in the web running direction. The apparatus further includes at least one deflection device configured for deflecting the edge strip away from the transfer strip and simultaneously tautening the edge strip upon deflection thereof.

28 Claims, 3 Drawing Sheets

METHOD AND APPARATUS FOR THE TRANSFERRING OF A FLEXIBLE MATERIAL WEB

BACKGROUND OF THE INVENTION

1. Field of the Invention

The invention relates to a method for the transferring of a flexible material web, in particular a paper or cardboard web, from an upstream section to at least one downstream section of a machine serving the manufacture and/or treatment of the material web. In particular, the invention relates to a paper machine in which the material web is split into an edge strip extending in the web running direction, an adjoining transfer strip and a remaining web portion adjoining this transfer strip.

2. Description of the Related Art

In a method of the kind initially mentioned known from WO 98/33974, a small strip (transfer strip) is cut out of the paper web at the end of the drying part to facilitate the transfer of the paper or cardboard web, etc., from the end of the drying part of a paper machine to downstream machine portions or sections such as the calender, winding apparatus, etc. While the remaining, adjoining sections of the web are guided straight into a pulper or waste dissolver, the strip is transferred into the downstream machine sections by aids such as rope guides, transfer belts, etc.

However, this arrangement now results in a relatively unstable running of the strip through the downstream machine sections, which can result in time-consuming and expensive web breaks.

If the transfer strip is formed from the edge strip, there is a risk of having its run impaired by the air movements in the support region, e.g. in the machine section of a winding apparatus.

SUMMARY OF THE INVENTION

It is the aim of the invention to provide a method and an apparatus of the kind initially mentioned in which the above disadvantages are eliminated and in which the fastest and safest transfer of the material web possible is ensured in a simple and reliable manner. Furthermore, the safest possible separation of the transfer strip from the remaining material web and the most stable movement possible of the separated transfer strip up to the machine element at the end of the transfer distance should be ensured.

Specifically, the method of the invention features the steps of deflecting the edge strip to the side and away from the transfer strip and simultaneously tautening that edge strip.

A fast and safe transfer of the material web is ensured in a simple and reliable manner on the basis of its design. An extremely stable running of the transfer strip over the whole transfer distance is ensured thereby. It also prevents the edge strip from running along with the transfer strip during the transfer procedure, which had previously resulted in breaks. The edge strip can, in particular, be led into a pulper or waste container.

The deflection of the edge strip preferably takes place by use of at least one air jet or by use of a guide apparatus.

In accordance with an expedient embodiment of the method of the invention, the first separation element, disposed closest to the relevant web edge, is activated in order to produce the edge strip and, subsequently, with the edge strip already tautened and deflected, the other separation element is activated in order to produce the transfer strip.

After a transfer of the transfer strip to at least one downstream machine section, the separation element, further removed from the relevant web edge, can be moved to the opposite web edge to separate the remaining web. The separation element disposed most closely to the relevant web edge can accordingly be moved to the relevant web edge to separate the edge strip.

In a preferred embodiment of the method of the invention, the transfer strip is first produced at a smaller spacing to the relevant web edge, and the spacing to the web edge is subsequently enlarged by an appropriate movement of the separation elements in a transverse direction. The maximum spacing of the transfer strip to the relevant web edge is preferably smaller than its spacing to the opposite web edge. The transfer strip can accordingly be correspondingly positioned with respect to a downstream machine section by a movement of the separation elements in a transverse direction. The transfer strip can, in particular, be positioned such that it is ultimately taken up in its overall width in the relevant downstream machine section. It can thus be ensured in a simple and reliable manner that, for example, the transfer strip is gripped in its overall width by a respective roll nip, e.g. a winding nip or the like.

Accordingly, the transfer strip may first be produced at a smaller spacing to the relevant web edge for its transfer to at least a first machine section and subsequently be enlarged by an appropriate movement of the separation elements in a transverse direction for its transfer into at least one further machine section.

The desired width of the transfer strip can also be set by an appropriate movement of the separation elements in a transverse direction.

A separation element may work in a non-contact manner and may be, in particular, a high pressure water jet separation element or a laser beam separation element. Conversely, the separation element may be a mechanical cutting element such as a knife element or a circular knife element.

When separation elements working in a non-contact manner are used in a paper machine, it is of advantage if the separating procedure takes place at the last dryer cylinder. If mechanically working cutting elements are used as the separation elements, then the separating procedure preferably takes place in a non-supported run of the material web.

The material web is preferably led into the pulper or waste container at the start of the separating procedure.

In a preferred embodiment of the method of the invention, it is provided that both separation elements are applied within the material web and that the separation is begun accordingly within this material web. Alternatively, it is also possible to activate at least one separation element outside the material web.

The edge strip and the remaining web are preferably led into one of a pulper and waster container up to the widening of the transfer strip.

The transfer strip can be transferred to the downstream machine section via at least one auxiliary transfer device, e.g., a rope guide, a transfer belt, an air guide device and/or the like.

The edge strip is expediently produced with a width which is in range from around 50 mm to around 300 mm and preferably in a range from around 50 mm to around 250 mm.

The transfer strip is expediently produced with a width which is in a range from around 50 mm to around 400 mm and preferably in a range from around 50 mm to around 200 mm.

In accordance with a preferred practical embodiment, the spacing of the transfer strip produced from its edge disposed most closely to the relevant web edge to the support edge or to the rope guides is greater than around 150 mm and preferably, is in a range from around 150 mm to around 1,000 mm.

The apparatus of the invention includes a device for deflecting the edge strip to the side of and away from the transfer strip and for simultaneously tautening it.

The method of the invention and the apparatus of the invention can, for example, be used for a transfer from the drying part to a winding apparatus; from the drying part to a calender and via this calender to a winding apparatus; or from the drying part to a coating unit, size press and/or the like; or for the transfer starting from a drying part section or a pre-drying part. The transfer can, in particular, take place in the edge region, e.g. at the operator side of the paper machine. The transfer strip is advantageously cut from a region of the web further removed from the support. It is of advantage, however, that the spacing is not too large, so that accessibility for waste elimination is given in the event of a break.

It is possible by an appropriate movement of the separation elements to guide the transfer strip at an optimum spacing to the web edge in every machine section. If, for example, a transfer takes place from the drying part via an online calender to a winding apparatus, then the transfer strip can first be cut out at a similar spacing to the web edge during the transfer via the calender, since the transfer strip can be guided via the calender, for example, with the aid of transfer ropes, etc. In the next step, the spacing of the transfer strip to the web edge can then be enlarged by an appropriate movement of the separation element pair in order to achieve optimum relationships, especially in the region of the winding nip at the winding apparatus. The running reliability of the transfer strip is improved thereby. It is important here that the transfer strip is taken up by the winding nip at least at its whole width.

The invention can also be used particularly advantageously in such an operating state in which a reel already partly wound with paper is provided instead of an empty reel in a winding apparatus. This situation is found, for example, in the event of a paper web break. To ensure that, for a reliable transfer, the full width of the transfer strip is taken up by the winding nip formed by the pope reel and the paper layers of the partly wound reel, the transfer strip must be brought into the appropriate position. The proper positioning may be achieved in a simple and reliable manner in accordance with the invention by an appropriate movement of the separation element pair. The respective position is dependent on the paper format, i.e., the width of the paper web produced. This width is in turn dependent on the kind of paper produced and the respective customer wishes.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
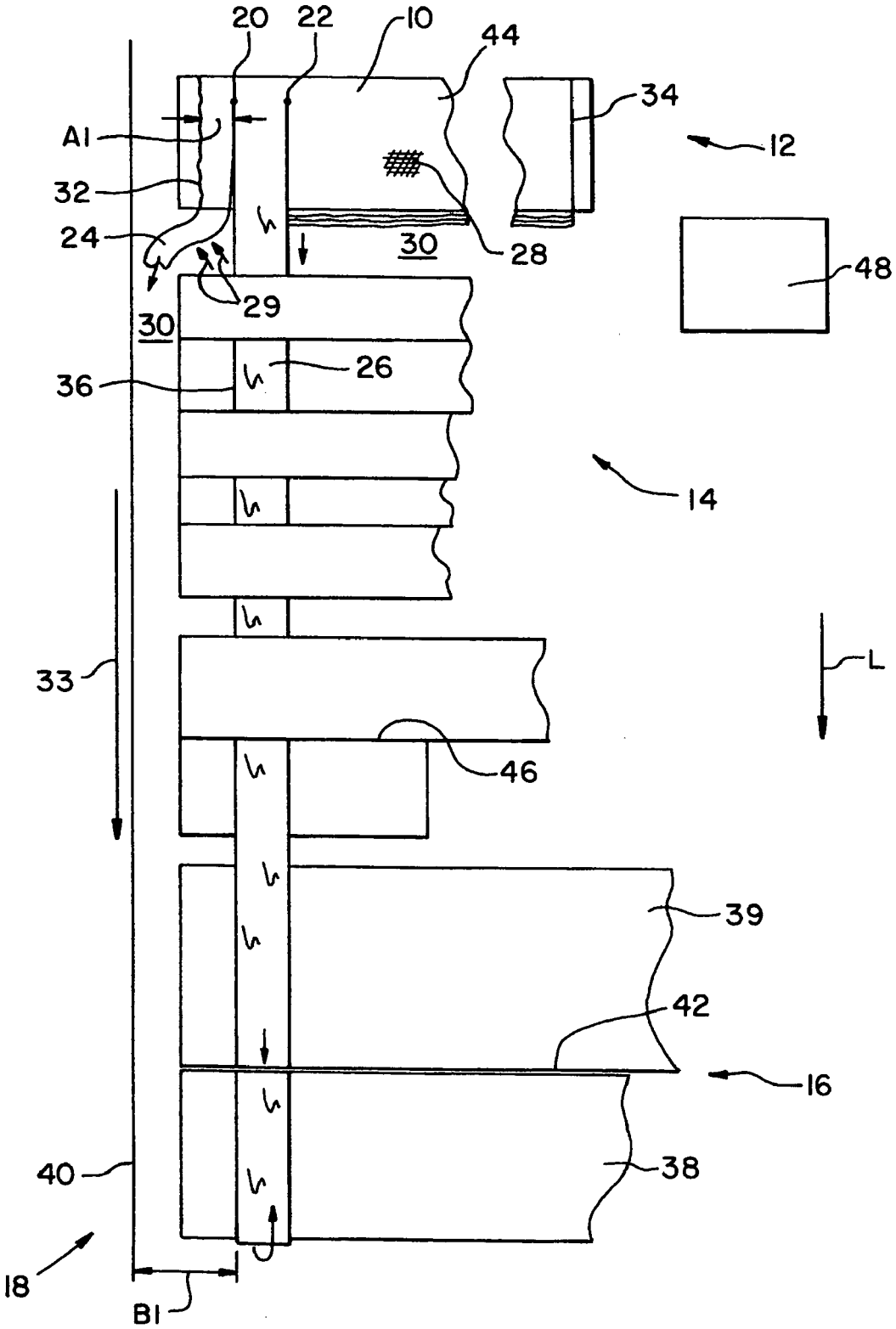
FIG. 1 is a schematic representation of an apparatus for the transfer of a paper or cardboard web from the last drying cylinder to a winding apparatus via a calender, with the transfer strip being guided to an empty reel.

Corresponding reference characters indicate corresponding parts throughout the several views. The exemplifications set out herein illustrate at least one preferred embodiment of the invention, in one form, and such exemplifications are not to be construed as limiting the scope of the invention in any manner.

DETAILED DESCRIPTION OF THE INVENTION

Figure 2:
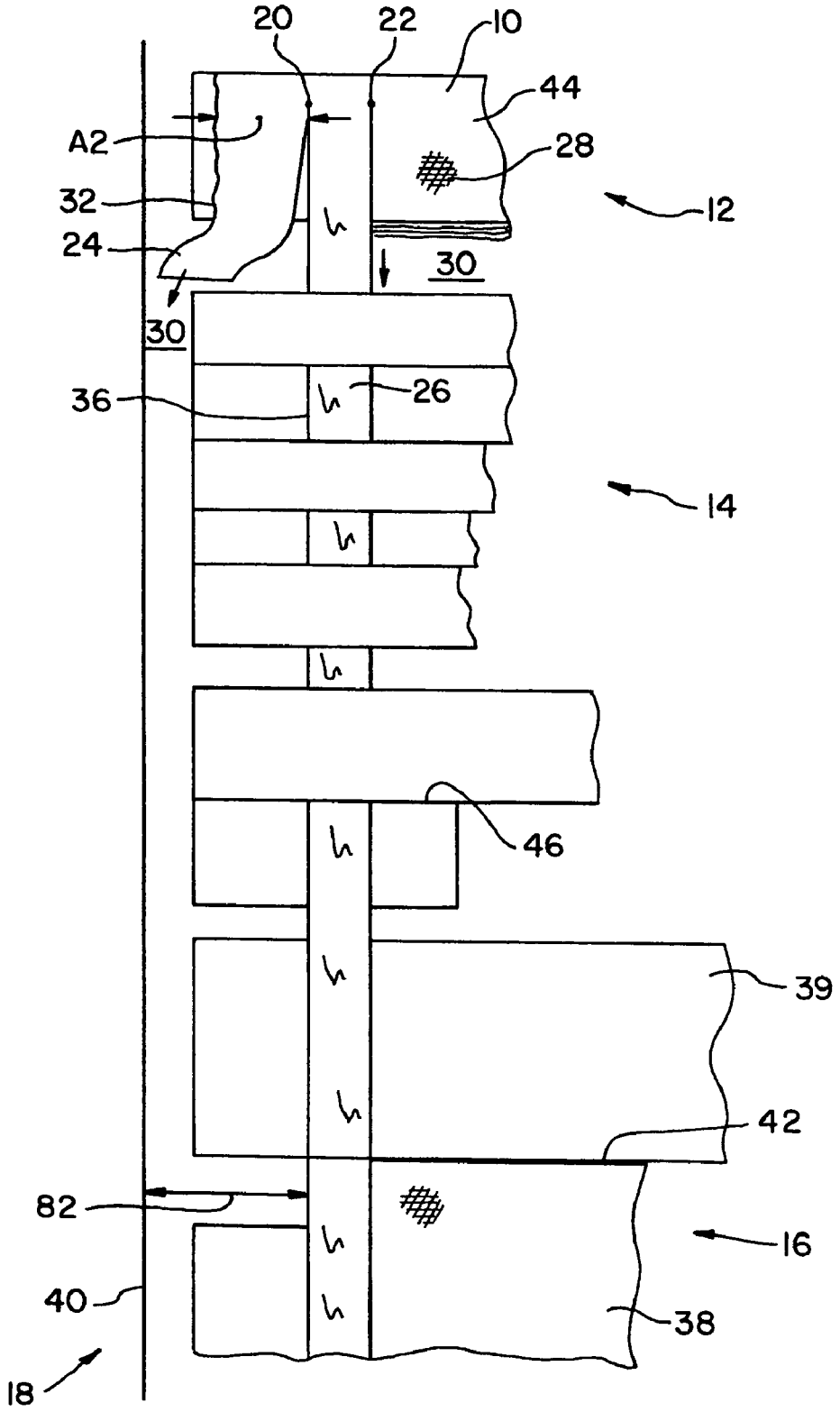
FIG. 2 is a schematic representation comparable to FIG. 1, with, however, a web break being present and the paper or cardboard web being accordingly transferred to an already partly wound reel.

The apparatus illustrated in FIGS. 1 and 2 facilitates the transfer of a flexible material web, e.g., a paper or cardboard web 10, from an upstream machine section, e.g., a drying part 12 to at least one downstream section, e.g., a calender 14 and a following winding apparatus 16, of a machine serving the manufacture and/or treatment of material web 10. In the present case such a machine is a paper machine 18.

Material web 10 is split by two separation elements 20, 22 into an edge strip 24 extending in a web running direction L, an adjoining transfer strip 26 and a remaining web 28 adjoining transfer strip 26.

As can be seen from FIGS. 1 and 2, edge strip 24 is deflected to the side of and away from transfer strip 26, with edge strip 24 simultaneously being tautened, for example, by using a deflection device, which, in the embodiment shown in FIGS. 1 and 2, is comprised of at least one air jet 29. Edge strip 24 is then guided into a waste container or pulper 30. Other suitable devices may also be employed instead of or in conjunction with air jet(s) 29 for deflecting edge strip 24.

Separation element 20, disposed most closely to the relevant web edge 32, is preferably activated first in order to produce edge strip 24, and, subsequently, separation element 22 is activated—with edge strip 24 already tautened and deflected—in order to produce transfer strip 26.

At least one auxiliary transfer device 33 (shown schematically in FIG. 1), each of which is one of, for example, a rope guide, a transfer belt, and an air guide device, can be used to transport transfer strip 26 to at least one of downstream machine sections 14, 16.

After a transfer of transfer strip 26 to at least one downstream machine section 14, 16, separation element 22, further removed from relevant web edge 32, is moved to opposite web edge 34 in order to separate remaining web 28.

After a transfer of transfer strip 26 to at least one downstream machine section 14, 16, separation element 20, disposed most closely to relevant web edge 32, is moved to relevant web edge 32 in order to separate edge strip 24.

At least at the start of the transfer procedure, transfer strip 26 is produced such that edge 36 thereof, disposed most closely to the relevant web edge 32, has a smaller spacing A1 to relevant web edge 32 and accordingly a smaller spacing B1 to support edge 40.

In the embodiment shown in FIG. 1, in which material web 10 is ultimately transferred to an empty reel 38 of winding apparatus 16, smaller spacing A1 of transfer strip 26 to web edge 32 and/or smaller spacing B1 thereof to support edge 40 is preferably maintained.

On the other hand, transfer strip 26, first produced (cf. FIG. 1) at smaller spacing A1 to relevant web edge 32 or at smaller spacing B1 to support edge 40, can be used for the transfer of material web 10 to an already partly wound reel 38' (see FIG. 2). In such an instance spacing to web edge 32 or to support edge 40 is subsequently enlarged to, for example, a value A2 or B2, respectively, by an appropriate movement of the separation elements 20, 22 in a transverse direction, with the greater distance A2 of transfer strip 26 to web edge 32 also being even smaller than the spacing thereof to opposite web edge 34.

Transfer strip 26 can thus be positioned in the desired manner by a movement of separation elements 20, 22 in a transverse direction with respect, for example, to winding nip 42 of winding apparatus 16 between reel 38 and a pope reel 39, with transfer strip 26, in particular, being positioned so as to be ultimately taken up in its total width in the relevant downstream machine section, here, in winding apparatus 16.

A separation element working in a non-contact manner (e.g., a water jet or laser beam separation element) or a mechanical cutting element (e.g., a knife or circular knife element) can, for example, be used as separation element 20, 22. If separation elements 20, 22 working in a non-contact manner are used, then the separating procedure expediently takes place at last drying cylinder 44 of drying part 12. If mechanically working cutting elements are used as separation elements 20, 22, then the separating procedure expediently takes place in a non-supported run of material web 10.

Material web 10 is guided into pulper 30 prior to the start of the separating procedure. It is scraped off the surface of drying cylinder 44 by a scraper (not shown). Edge strip 24 and remaining web 28 are also guided into pulper 30 up to the widening.

Edge strip 24 can be produced with a width, for example, which is in a range from around 50 mm to around 300 mm and preferably in a range from around 50 mm to around 250 mm. Transfer strip 26 is produced with a width, for example, which is in a range from around 50 mm to around 400 mm and preferably in a range from around 50 mm to around 200 mm.

Transfer strip 26 is expediently produced such that edge 36 thereof, disposed most closely to the web edge 32, has a spacing B1, B2 to support edge 40 which is in a range from around 150 mm to around 1,000 mm.

In, for example, a direct transfer of material web 10 from drying part 12 to winding or roll apparatus 16, the following method steps can, for example, be provided:

- positioning separation elements 20, 22 such that the whole width of transfer strip 26 is taken up by nip 42 at the end of relevant downstream machine section 16;
- activating separation element 20, disposed most closely to web edge 32, for the cutting of an edge strip 24;
- tautening of edge strip 24;
- deflecting edge strip 24 outwardly away from the separated portion of material web 10;
- activating second separation element 22 for the cutting of transfer strip 26;
- transferring transfer strip 26 into auxiliary transfer units and from there to the next machine section;
- moving second separation element 22 to opposite edge 34 of material web 10 and cutting through remaining web 28;
- moving first separation element 20 to web edge 32 and cutting edge strip 24;
- deactivating the cutting function of separation elements 20, 22; and
- moving separation elements 20, 22 into the respective starting positions thereof.

In particular, with a procedure for transferring of material web 10 from drying part 12 via online calender 14 (cf. FIGS. 1 and 2) to winding or roll apparatus 16, the following method steps are possible, for example:

- locating separation elements 20, 22 in their respective separating positions;
- activating separation element 20, disposed most closely to web edge 32, for the cutting of edge strip 24;
- tautening edge strip 24;
- deflecting edge strip 24 outwardly away from the separated portion of material web 10;
- activating second separation element 22 for the cutting of transfer strip 26;
- transferring transfer strip 26 in auxiliary transfer devices and from there or via next machine section 14 up to roll nip 46 ("pull stack") for the clamping and tautening of transfer strip 26, with this "pull stack" being arranged here between two machine sections 14, 16;
- displacing transfer strip 26 to another width position matched to second machine section 16 by moving separation elements 20, 22 into the new width position (cf. FIG. 2);
- optimizing the width of transfer strip 26 by an appropriate changing of the spacing between separation elements 20, 22;
- transferring transfer strip 26 in auxiliary transfer devices and from there to the next but one machine section;
- moving second separation element 22 to opposite web edge 28 and cutting through remaining web 28;
- moving first separation element 20 to adjacent web edge 32 and cutting through edge strip 24;
- deactivating the cutting function of separation elements 20, 22;
- moving separation elements 20, 22 into their respective starting positions (e.g. separation position of each).

Separation elements 20, 22 are controlled by an electronic control 48.

Figure 3:
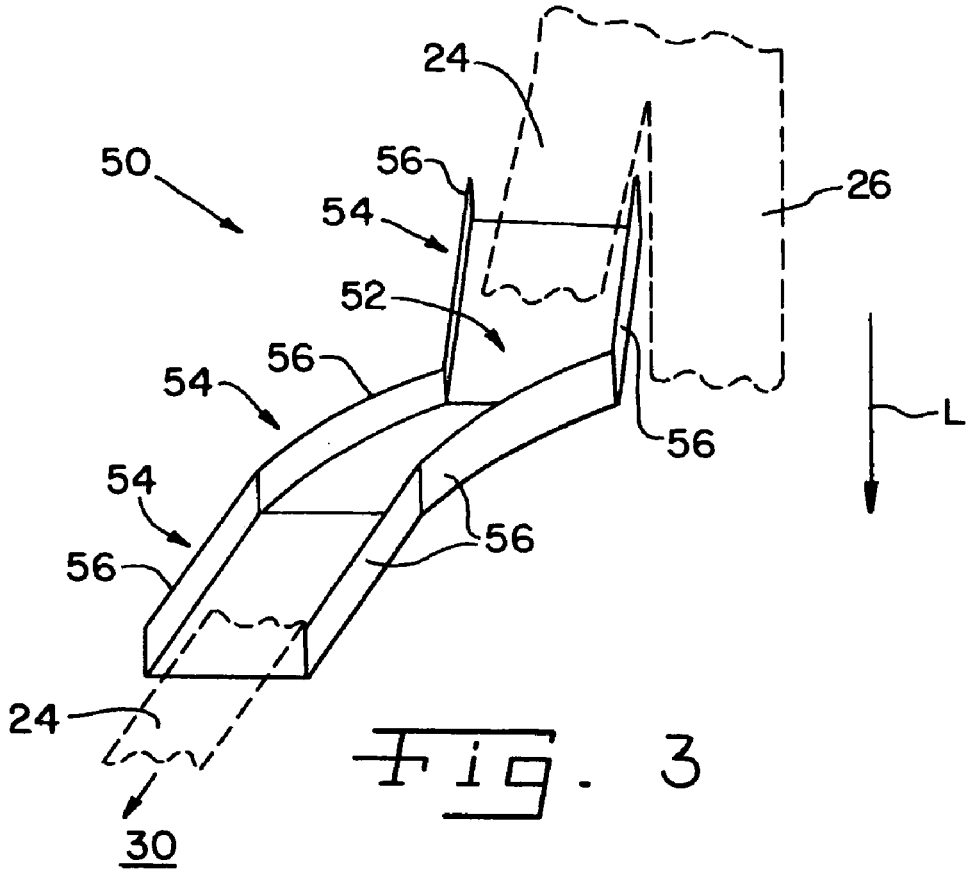
FIG. 3 is a perspective view of an alternate deflecting device of the present invention.

In an alternate embodiment shown in FIG. 3, the at least one said deflection device for deflecting edge strip 24 away from transfer strip 26 (both shown in part in phantom in FIG. 3) is a guide apparatus 50. Guide apparatus 50 has a guide surface 52 which, considered in web running direction L, begins in a flat plane for first receiving edge strip 24 and then merges therefrom into a curved, outwardly extending contact surface for edge strip 24. Guide apparatus 50 is preferably made of a plurality of at least essentially planar guide panels 54 provided with side walls 56, guide panels 54 being arranged in cascade form. Most preferably, there are three such guide panels 54. However, guide apparatus 50 could be made unitary in construction.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for transferring a flexible material web from an upstream section to at least one downstream section of a machine having a web running direction, said machine being configured for at least one of manufacturing and treating the material web, said apparatus comprising:

two separation elements configured for splitting and thereby separating the material web into an edge strip, an adjoining transfer strip and a remaining web adjoining the transfer strip, the edge strip extending in the web running direction, the transfer strip having a side, said edge strip has a relevant web edge, a first of said separation elements being configured to be disposed most closely to the relevant web edge, said first of said separation elements being configured to be activated first in order to produce the edge strip, a second of said separation elements being configured to be subsequently activated to produce the transfer strip after tautening and deflection of the edge strip; and at least one deflection device configured for deflecting the edge strip to the side of and away from the transfer strip and simultaneously tautening the edge strip upon deflection thereof, at least one said deflection device being a guide apparatus provided for deflecting the edge strip, said guide apparatus having a guide surface which, considered in the web running direction, begins in a flat plane for first receiving the edge strip and then merges therefrom into a curved, outwardly extending contact surface for the edge strip, said guide apparatus comprising a plurality of at least essentially planar guide panels provided with side walls, said guide panels being arranged in cascade form.

2. The apparatus of claim 1, wherein at least one said deflection device is an air jet configured for direction at the edge strip.

3. The apparatus of claim 1, wherein there are three guide panels.

4. The apparatus of claim 1, further comprising an electronic control for controlling movement of said separation elements, said separation elements being controllably movable in a direction transverse to the web running direction.

5. The apparatus of claim 1, wherein said edge strip has a relevant web edge and the remaining web has an opposite web edge, a second of the separation elements being configured to be further disposed from the relevant web edge, said second of the separation elements being configured to be moved to the opposite web edge to separate the remaining web upon transferring the transfer strip to at least one downstream machine section.

6. The apparatus of claim 1, wherein the edge strip has a relevant web edge, a first of the separation elements being configured to be disposed most closely to the relevant web edge, said second of the separation elements being configured to be moved to the relevant web edge to separate the edge strip upon transferring the transfer strip to at least one downstream machine section.

7. The apparatus of claim 1, wherein the edge strip has a relevant web edge, the apparatus being configured for producing the transfer strip in the region of the relevant web edge at least at a beginning of a transfer procedure.

8. The apparatus of claim 1, wherein the edge strip has a relevant web edge, the apparatus being configured to first produce the transfer strip at a small spacing to the relevant web edge, at least one of said separation elements being configured for movement in a direction transverse to the web running direction and for thereby subsequently enlarging the spacing of the transfer strip to the relevant web edge.

9. The apparatus of claim 8, wherein the remaining web has an opposite web edge, the apparatus being configured to control a maximum spacing of the transfer strip to the relevant web edge so as to be smaller than a spacing thereof to the opposite web edge.

10. The apparatus of claim 8, wherein said at least one of said separation elements is configured for moving in a transverse direction with respect to at least one said downstream machine section and for accordingly positioning the transfer strip.

11. The apparatus of claim 10, wherein the apparatus is configured so as to position the transfer strip such that ultimately the whole width thereof is taken up in an appropriate downstream machine section.

12. The apparatus of claim 8, wherein said at least one downstream machine section includes at least one first machine section and at least one further machine section, the apparatus being configured for first producing the transfer strip at a smaller spacing to the relevant web edge for a transfer thereof into said at least one first machine section, the spacing to the relevant web edge being subsequently enlarged for a transfer of the transfer strip into said at least one further machine section, the enlarging occurring due to an appropriate movement of at least one separation element in the transverse direction.

13. The apparatus of claim 1, wherein said separation elements are conjunctively configured for movement in a manner appropriate to set a desired width of the transfer strip, the movement of each separation element being in a direction transverse to the web running direction.

14. The apparatus of claim 1, wherein each said separation element is configured to work one of in a non-contact manner and as a mechanical cutting element.

15. The apparatus of claim 14, wherein at least one said separation element is configured to work in a non-contact manner, said at least one said separation element being one of a water jet and a laser beam separation element.

16. The apparatus of claim 14, wherein at least one said separation element is configured to work as a mechanical cutting element, said at least one said separation element being one of a knife and a circular knife element.

17. The apparatus of claim 14, wherein said machine is a paper machine including at least a last drying cylinder, each said separation element working in a non-contact manner, the separating occurring on the last drying cylinder.

18. The apparatus of claim 14, wherein each said separation element is a mechanical cutting element, the separating occurring in a non-supported run of the material web.

19. The apparatus of claim 1, wherein both separation elements are configured to be applied within the material web and accordingly beginning the separating therewithin.

20. The apparatus of claim 1, wherein at least one said separation element is configured to be activated outside the material web.

21. The apparatus of claim 1, further comprising at least one auxiliary transfer device configured for transferring the transfer strip to said at least one downstream section.

22. The apparatus of claim 21, wherein each auxiliary transfer device is one of a rope guide, a transfer belt and an air guide device.

23. The apparatus of claim 1, wherein said separation elements are conjunctively configured for controlling a width of the edge strip within an approximate range of 50 mm to 300 mm.

24. The apparatus of claim 23, wherein the approximate range is 50 mm to 250mm.

25. The apparatus of claim 1, wherein said separation elements are conjunctively configured for controlling a width of the transfer strip within an approximate range of 50 mm to 400 mm.

26. The apparatus of claim 25, wherein the approximate range is 50 mm to 200 mm.

27. The apparatus of claim 1, wherein the edge strip has a relevant web edge, the machine having at least one of a support edge and an auxiliary guide, the transfer strip having a first strip edge most disposed most closely to the relevant web edge, the apparatus being configured such that the first strip edge is spaced more than approximately 150 mm from said at least one of a support edge and an auxiliary guide.

28. The apparatus of claim 27, wherein the edge strip has a relevant web edge, the machine having at least one of a support edge and an auxiliary guide, the transfer strip having a first strip edge most disposed most closely to the relevant web edge, the apparatus being configured such that the first strip edge is spaced approximately 150 mm to approximately 1000 mm from said at least one of a support edge and an auxiliary guide.

* * * * *